US010450847B2

(12) United States Patent
Bailey et al.

(10) Patent No.: US 10,450,847 B2
(45) Date of Patent: Oct. 22, 2019

(54) SUBSURFACE RECIPROCATING PUMP FOR GASSY AND SANDY FLUIDS

(71) Applicant: Weatherford Technology Holdings, LLC, Houston, TX (US)

(72) Inventors: Jason W. Bailey, Houston, TX (US); John E. Stachowiak, Houston, TX (US); Douglas Hebert, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 275 days.

(21) Appl. No.: 15/489,951

(22) Filed: Apr. 18, 2017

(65) Prior Publication Data

US 2018/0298736 A1 Oct. 18, 2018

(51) Int. Cl.

| | |
|---|---|
| ***E21B 43/38*** | (2006.01) |
| ***E21B 43/08*** | (2006.01) |
| ***F04B 47/02*** | (2006.01) |
| ***E21B 43/12*** | (2006.01) |
| ***F04B 53/16*** | (2006.01) |

(Continued)

(52) U.S. Cl.

CPC ..... *E21B 43/126* (2013.01); *E21B 43/08* (2013.01); *E21B 43/127* (2013.01); *F04B 13/00* (2013.01); *F04B 47/02* (2013.01); *F04B 47/06* (2013.01); *F04B 53/143* (2013.01); *F04B 53/166* (2013.01); *F04B 53/20* (2013.01); *F04B 53/12* (2013.01)

(58) Field of Classification Search

CPC ..... E21B 43/121; E21B 43/126; E21B 43/38; E21B 43/08; F04B 47/02; F04B 47/022; F04B 47/026; F04B 53/166; F04B 53/20; F04B 53/143; F04B 53/12; F04B 53/125

USPC ..... 417/555.2

See application file for complete search history.

(56) References Cited

U.S. PATENT DOCUMENTS

| | | | |
|---|---|---|---|
| 528,436 | A | 10/1894 | Jones |
| 1,313,245 | A | 8/1919 | Andrews |

(Continued)

FOREIGN PATENT DOCUMENTS

| | | | |
|---|---|---|---|
| WO | 1995/034742 | A1 | 12/1995 |
| WO | 1996/032599 | A1 | 10/1996 |
| WO | 2014/110681 | A1 | 7/2014 |

OTHER PUBLICATIONS

Harbison-Fischer, "Rod Pumps and Accessories for Fluid Production with Sand and Particulates," Brochure HF-2-08-2, obtained from www.hfpumps.com, undated.

(Continued)

*Primary Examiner* — Catherine Loikith

(74) *Attorney, Agent, or Firm* — Blank Rome, LLP

(57) ABSTRACT

An artificial lift system for a well has a surface unit and a subsurface pump. The surface unit reciprocates a rod in the well, and the pump disposed in a tubular in the well is actuated by the rod. A barrel of the pump has a standing valve restricting fluid passage out of the barrel. The plunger is reciprocally disposed in the barrel and has seals with the barrel. A traveling valve of the plunger uses a sleeve and a bob. The sleeve is movable relative to the bob to restrict fluid out of the plunger's interior through a variable gap relative to the bob and the sleeve. The filter is disposed on the plunger between the seals and separates the plunger's interior from an annulus between the plunger and the barrel. The filter restricts particulate in the interior from passing into the annulus.

20 Claims, 5 Drawing Sheets

(51) Int. Cl.

| | |
|---|---|
| ***F04B 53/20*** | (2006.01) |
| ***F04B 53/14*** | (2006.01) |
| ***F04B 47/06*** | (2006.01) |
| ***F04B 13/00*** | (2006.01) |
| *F04B 53/12* | (2006.01) |

(56) References Cited

U.S. PATENT DOCUMENTS

| | | | |
|---|---|---|---|
| 1,338,829 | A | 5/1920 | Green |
| 1,545,475 | A | 7/1925 | Adams |
| 1,549,175 | A | 8/1925 | Adams et al. |
| 1,983,490 | A | 12/1934 | Penrod |
| 2,160,811 | A | 6/1939 | Adams |
| 3,114,327 | A | 12/1963 | Reynolds |
| 3,479,958 | A | 11/1969 | Anderson et al. |
| 3,958,634 | A | 5/1976 | Smith |
| 4,569,396 | A | 2/1986 | Brisco |
| 4,621,987 | A | 11/1986 | Spingath |
| 4,662,831 | A | 5/1987 | Bennett |
| 4,867,242 | A | 9/1989 | Hart |
| 4,968,226 | A | 11/1990 | Brewer |
| 5,018,581 | A | 5/1991 | Hall |
| 5,141,411 | A | 8/1992 | Klaeger |
| 5,494,102 | A | 2/1996 | Schulte |
| 5,494,109 | A | 2/1996 | Schmitt |
| 5,660,534 | A | 8/1997 | Snow |
| 6,116,613 | A | 9/2000 | Friend et al. |
| 6,145,590 | A | 11/2000 | Havard |
| 6,273,690 | B1 | 8/2001 | Fischer, Jr. et al. |
| 6,481,987 | B2 | 11/2002 | Ford |
| 6,883,612 | B2 | 4/2005 | Ferguson et al. |
| 6,905,114 | B2 | 6/2005 | Ford |
| 6,926,504 | B2 | 8/2005 | Howard |
| 6,945,762 | B2 | 9/2005 | Williams |
| 6,966,248 | B2 | 11/2005 | Mahoney |
| 7,008,197 | B2 | 3/2006 | Ford |
| 7,404,702 | B2 | 7/2008 | Ford |
| 7,428,923 | B2 | 9/2008 | Ford |
| 7,458,787 | B2 | 12/2008 | Brown |
| 7,686,598 | B2 | 3/2010 | Williams |
| 7,909,589 | B2 | 3/2011 | Williams |
| 8,858,187 | B2 | 10/2014 | Lane |
| 2005/0226752 | A1 | 10/2005 | Brown |
| 2005/0265875 | A1 | 12/2005 | Williams et al. |
| 2006/0083646 | A1 | 4/2006 | Ford |
| 2007/0154324 | A1 | 7/2007 | Williams |
| 2008/0179560 | A1 | 7/2008 | Ford |
| 2008/0217565 | A1 | 9/2008 | Ford |
| 2009/0053087 | A1 | 2/2009 | Ford |
| 2009/0068042 | A1 | 3/2009 | Ford |
| 2011/0008180 | A1 | 1/2011 | Williams |
| 2012/0251337 | A1 | 10/2012 | Freeman |
| 2013/0039780 | A1 | 2/2013 | Lane |

OTHER PUBLICATIONS

Ghareeb, M.. "The Advancements/Enhancements in the Area of Sucker Rod Pumping Applications," Lufkin Industries, Inc., obtained from http://egypt.spe.org/images/egypt/articles/150/The%20Advancements2.pdf, copyright 2010.

Lea, J. et al., "Part 1—Recent Developements are introduced in three major artificial lift categories: sucker rod pumping, progressing cavity pumping and gas lift," World Oil, vol. 229 No. 4, Apr. 2008.

BMW-Monarch, "Reynold Plungers," undated, facsimile dated Aug. 19, 1998, 2-pgs.

Weatherford, "Sand-Tolerant Pump," Brochure, copyright 2015, 6-pgs.

Harbison-Fischer, "Specialty Rod Pump 1," obtained from http://oillifttechnology.com, generated Mar. 24, 2017, 3-pgs.

Harbison-Fischer, "Sand-Pro(TM) Pump," undated obtained from http://www.doverals.com/assets/img/brochures/HF_Sand_Pro_Pump_II-min.pdf on Mar. 24, 2017, 8-pgs.

Harbison-Fischer, "Rod Pumps and Accessories for Fluid Production with Sand and Particulates," undated obtained from http://www.red-adesigngroup.com/PDFs/Harbison_Fischer_Rod_Pumps_Catalog.pdf on Mar. 24, 2017, 20-pgs.

Takacs, G., excerpt of "Loc-No Plunger" on pp. 96-97 from "Sucker Rod Pumping Handbook," Elsevier,1st Ed., May 8, 2015.

Mahoney, M. et al., "Beam Pumping with Solids Present," Sucker Rod Pumping Workshop, Sep. 11-14, 2007, 46-pgs.

Weatherford, "Subsurface Rod Pumps, Parts and Accessories," Catalog, copyright 2008-2012, 264-pgs, see pp. 63-70.

Profile Wire Screen Products; AMISTCO Separation Products, Inc., www.amistco.com, 2008.

PCT Int'l Search Report and Written Opinion issued in copending PCT Application No. PCT/US2018/024255 dated Jul. 20, 2018, 15 pages.

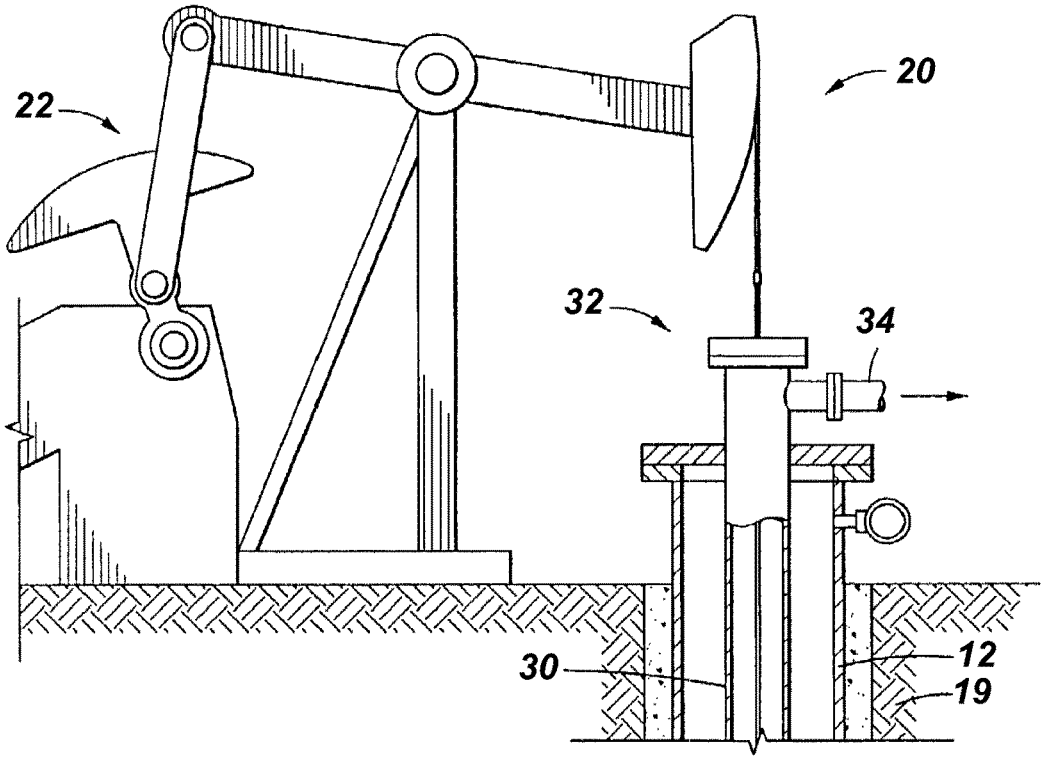
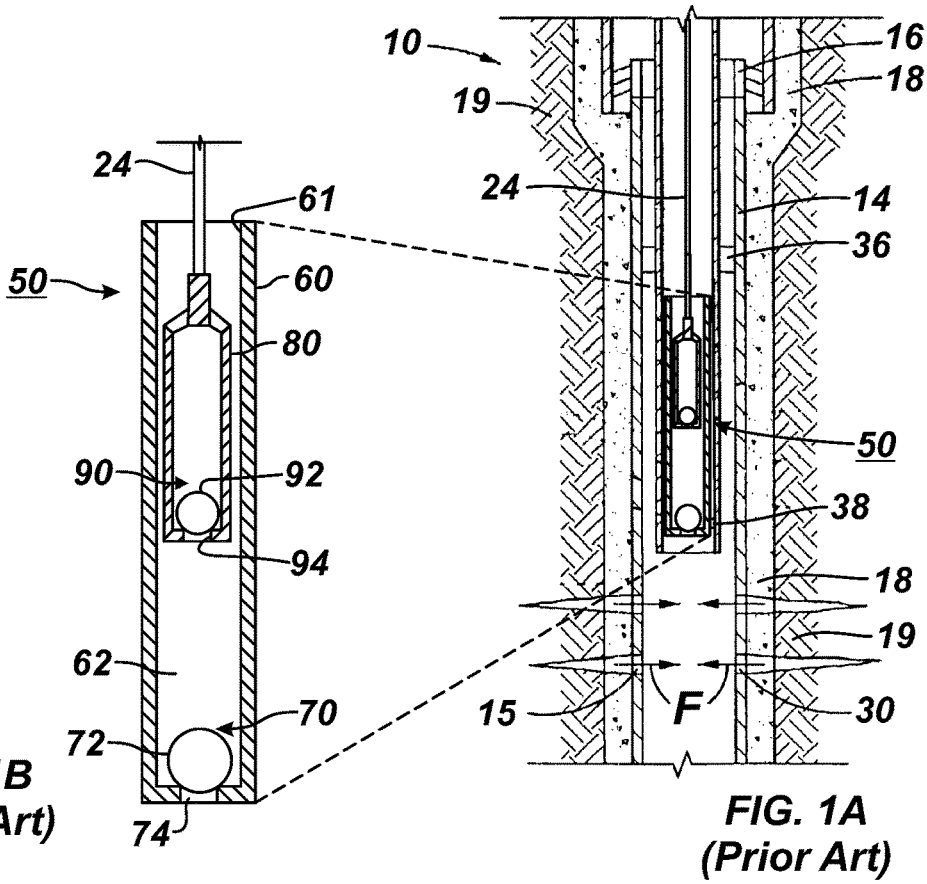
FIG. 1B
(Prior Art)
FIG. 1A
(Prior Art)

SUBSURFACE RECIPROCATING PUMP FOR GASSY AND SANDY FLUIDS

BACKGROUND OF THE DISCLOSURE

Many hydrocarbon wells are unable to produce at commercially viable levels without assistance in lifting the formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation and inhibits the unassisted flow of production fluid to the surface.

A common approach for urging production fluids to the surface uses a mechanically actuated, positive displacement pump. Reciprocal movement of a string of sucker rods induces reciprocal movement of the pump for lifting production fluid to the surface. For example, a reciprocating rod lift system 20 of the prior art is shown in FIG. 1A to produce production fluid from a wellbore 10. As is typical, surface casing 12 hangs from the surface and has a liner casing 14 hung therefrom by a liner hanger 16. Production fluid F from the formation 19 outside the cement 18 can enter the liner 14 through perforations 15. To convey the fluid, production tubing 30 extends from a wellhead 32 downhole, and a packer 36 seals the annulus between the production tubing 30 and the liner 14. At the surface, the wellhead 32 receives production fluid and diverts it to a flow line 34.

The production fluid F may not produce naturally reach the surface so operators use the reciprocating rod lift system 20 to lift the fluid F. The system 20 has a surface pumping unit 22, a rod string 24, and a downhole rod pump 50. The surface pumping unit 22 reciprocates the rod string 24, and the reciprocating string 24 operates the downhole rod pump 50. The rod pump 50 has internal components attached to the rod string 24 and has external components positioned in a pump-seating nipple 38 near the producing zone and the perforations 15.

As best shown in the detail of FIG. 1B, the rod pump 50 has a barrel 60 with a plunger 80 movably disposed therein. The barrel 60 has a standing valve 70, and the plunger 80 is attached to the rod string 24 and has a traveling valve 90. For example, the traveling valve 90 is a check valve (i.e., one-way valve) having a ball 92 and seat 94. For its part, the standing 70 disposed in the barrel 60 is also a check valve having a ball 72 and seat 74.

As the surface pumping unit 22 in FIG. 1A reciprocates, the rod string 24 reciprocates in the production tubing 30 and moves the plunger 80. The plunger 80 moves the traveling valve 90 in reciprocating upstrokes and downstroke. During an upstroke, the traveling valve 90 as shown in FIG. 1B is closed (i.e., the upper ball 92 seats on upper seat 94). Movement of the closed traveling valve 90 upward reduces the static pressure within the pump chamber 62 (the volume between the standing valve 70 and the traveling valve 90 that serves as a path of fluid transfer during the pumping operation). This, in turn, causes the standing valve 70 to unseat so that the lower ball 72 lifts off the lower seat 74. Production fluid F is then drawn upward into the chamber 62.

On the following downstroke, the standing valve 70 closes as the standing ball 72 seats upon the lower seat 74. At the same time, the traveling valve 90 opens so fluids previously residing in the chamber 62 can pass through the valve 90 and into the plunger 80. Ultimately, the produced fluid F is delivered by positive displacement of the plunger 80, out passages 61 in the barrel 60. The moved fluid then moves up the wellbore 10 through the tubing 30 as shown in FIG. 1A. The upstroke and down stroke cycles are repeated, causing fluids to be lifted upward through the wellbore 10 and ultimately to the earth's surface.

The conventional rod pump 50 holds pressure during a pumping cycle by using sliding mechanical and/or hydrodynamic seals disposed between the plunger's outside diameter and the barrel's inside diameter. Sand in production fluids and during frac flowback can damage the seals. In particular, the differential pressure across the seals causes fluid to migrate past the seals. When this migrating fluid contains sand, the seals can become abraded by the sand so the seals eventually become less capable of holding pressure. Overtime, significant amounts of sand can collect between the plunger and the barrel, causing the plunger to become stuck within the barrel.

Production operations typically avoid using such a rod pump in wellbores having sandy fluids due to the damage that can result. However, rod pumping in sandy fluids has been a goal of producers and lift equipment suppliers for some time. To prevent sand damage, screens can be disposed downhole from the pump 50 to keep sand from entering the pump 50 altogether. Yet, in some applications, using a screen in such a location may not be feasible, and the screen and the rathole below can become fouled with sand. In other applications, it may actually be desirable to produce the sand to the surface instead of keeping it out of the pump 50.

In addition to having sand or other solids, well fluids may also have a high volume of gas entrained therein. As noted above, pumping sandy fluid using a conventional pump causes premature plunger and barrel wear that decreases efficiency. For its part, pumping a gassy fluid decreases efficiency, can damage the pump and the rod string from fluid pounding, and can potentially lead to gas lock of the pump. Gas lock refers to the situation in which gas received into the subsurface pump 50 is alternately expanded and compressed in the pump 50 as the traveling valve 90 reciprocates, but fluid cannot flow into or out of the subsurface pump 50 due to the gas therein. Gas lock can result from gas being entrained in the fluid or can result from a pump-off condition (in which a liquid-gas interface in the well descends to below the stationary valve 70) so that the pump 50 will eventually no longer be able to pump a liquid component of the fluid.

Gas anchors have been used to address the issues with pumping of gassy fluid. Various types of gas anchors can be used, such as a natural gas anchor, a packer-type gas anchor, a poor boy gas anchor, and the like. In general, the gas anchor operates as a separator so that gas in well can be produced up the casing, while oil in the produced fluid enters the pump to be produced up the tubing disposed in the casing. The gas anchor can use features, such as tubing-intake perforations on the pump, a spill-over tube, a mud anchor with tubing-intake perforations, and a mud anchor with tubing-intake perforations and suction tube. A number of wells have casing and tubing dimensions that does not leave enough annulus for gas anchors to operate effectively.

According, a need exist for a subsurface pump capable of effectively handling high volumes of both solids and gas entrained in the well fluid. The subject matter of the present disclosure is directed to overcoming, or at least reducing the effects of, one or more of the problems set forth above.

SUMMARY OF THE DISCLOSURE

A subsurface pump for a reciprocating system comprises a barrel, a plunger, a sleeve, and a filter. The barrel has a first valve permitting fluid passage into the barrel and restricting fluid passage out of the barrel. The plunger is reciprocally disposed in the barrel, and the plunger has first and second seals in an annulus between the plunger and the barrel.

The plunger defines an interior therein and has a bob extending at a distal end of the plunger. The sleeve is movably disposed on the plunger relative to the bob at the distal end of the plunger and forms a second valve therewith. The second valve permits fluid passage from a variable volume of the barrel into the interior of the plunger and restricts fluid passage out of the interior.

The filter is disposed on the plunger between the first and second seals and separates the interior of the plunger from the annulus between the plunger and the barrel. The filter permits fluid passage between the interior and the annulus and restricts particulate in the interior from passing into the annulus.

The first seal can include one or more wiper seals disposed outside the plunger and engaging inside the barrel, although other seal arrangements could be used. The second seal can include a hydrodynamic fluid seal formed with fluid disposed in the annulus between the barrel and the plunger, although other seal arrangements could be used.

In general, wherein the filter can define at least one opening with a dimension, and the annulus can define an average clearance around an inside of the barrel and an outside of the plunger that is greater than or equal to the dimension of the at least one opening. The filter can thereby prevent particulate greater than a dimension from passing therethrough, and the annulus can define an average clearance around an inside of the barrel and an outside of the plunger that is greater than or equal to the dimension. In one configuration, the filter can include a wire-wrapped screen at least partially disposed about the plunger.

The first valve can include a check valve having a ball movable relative to a seat, although other types of valves could be used. As to the second valve, the sleeve movable relative to the bob at the distal end of the plunger can include a seat distanced by a variable gap from the bob and being engagable with the bob.

In a first stroke moving the barrel and the plunger relative to one another in a first direction (e.g., in a downstroke), the variable volume decreases, the first valve closes, and the second valve opens. In this first stroke, fluid entering the interior of the plunger from the variable volume through the second valve may clear particulate adjacent a portion of the filter exposed to the interior of the plunger.

In a second stroke moving the barrel and the plunger relative to one another in a second direction (e.g., in an upstroke), the variable volume increases, the first valve opens, and the second valve closes. In the second stroke, the filter can permit fluid passage from the interior of the plunger to the annulus and can prevent at least some particulate in the interior of the plunger from passing out of the interior to the annulus.

In one configuration, the plunger includes a coupling disposed in the interior of the plunger. A stem extends from the coupling to the bob, and the sleeve is movably disposed about the stem. In general, the coupling can define one or more fluid passageways communicating a lower portion of the interior with an upper portion of the interior past the coupling. More particularly, the one or more fluid passageways can include a plurality of the fluid passageways circumferentially arranged about a center portion of the coupling connected to the stem. These circumferentially-arranged fluid passageways can direct fluid from the lower portion toward an interior surface of the filter disposed inside the upper portion of the interior to clear the filter of particulate.

In an arrangement, the barrel can include a chamber disposed in the barrel relative to a downstroke extent of the plunger in which liquid and gas is exchanged through the filter between the chamber of the barrel and the interior of the plunger. The chamber can be also disposed in the barrel relative to an upstroke extent of the plunger in which liquid and gas is exchanged between the chamber of the barrel and the variable volume in the barrel between the first and second valves.

The disclosed subsurface pump can be used in a reciprocating rod system for a well. In addition to the subsurface pump, the system can include a surface unit reciprocating a rod in the well connected to the plunger of the pump. In operating the system to produce fluid in a sandy and gassy well, the plunger is sealably disposed in a barrel with first and second seals. A first volume of fluid trapped in a first interior of the barrel is transferred into a second interior of the plunger by reciprocating the plunger and the barrel relative to one another in a first direction (e.g., downstroke) and unseating a movable sleeve on the plunger from a distal bob. The unseating of the sleeve essentially opens a traveling valve on the plunger.

A second volume of fluid trapped in the second interior of the plunger is then lifted by reciprocating the plunger and the barrel relative to one another in a second direction (e.g., upstroke) and seating the movable sleeve on the plunger against the distal bob. The seating of the sleeve essentially closes the traveling valve on the plunger.

Particulate uphole of the plunger is prevented from passing in an annulus between the plunger and the barrel using the first seal. Fluid communication is permitted between the second interior of the plunger and the annulus between the first and second seals. At least some particulate in the second interior of the plunger is presented from passing out of the plunger to the annulus.

The foregoing summary is not intended to summarize each potential embodiment or every aspect of the present disclosure.

BRIEF DESCRIPTION OF THE DRAWINGS

FIG. 1A illustrates a reciprocating rod lift system having a rod pump according to the prior art.

FIG. 1B illustrates a detailed cross-sectional view of the rod pump of FIG. 1A.

DETAILED DESCRIPTION OF THE DISCLOSURE

Figure 2A:
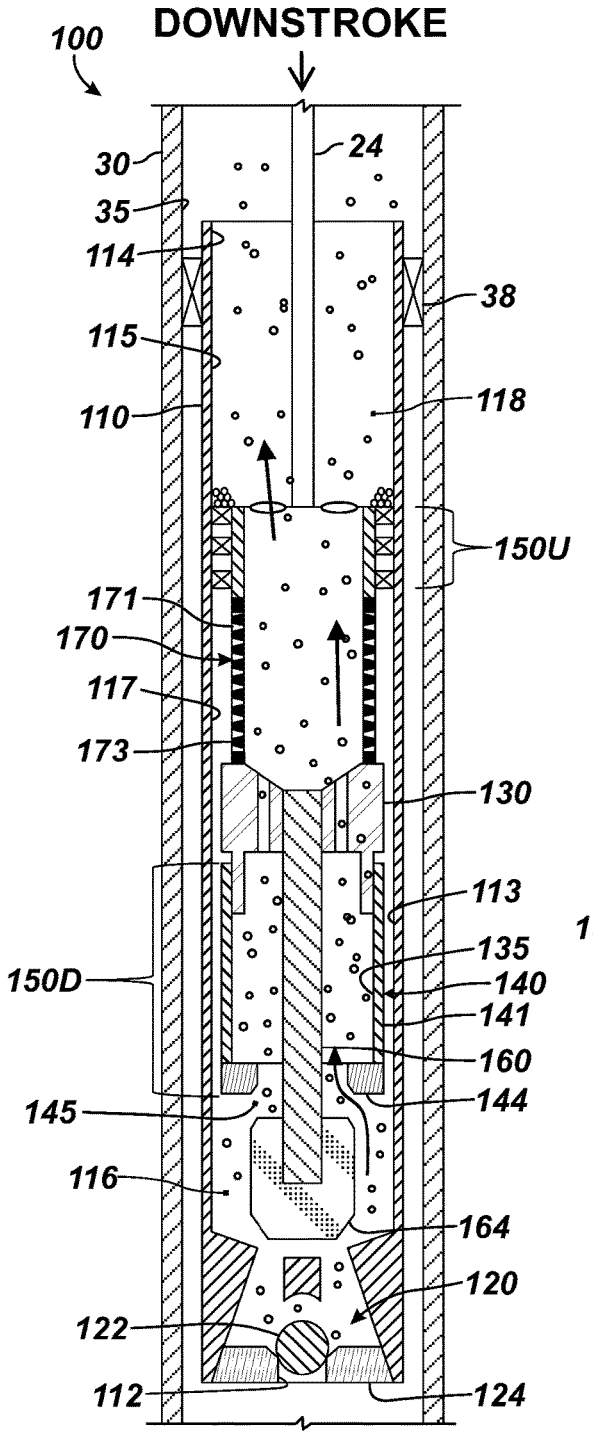
FIG. 2A illustrates a subsurface rod pump according to the present disclosure for use in a sandy and gassy well during a downstroke.
Figure 2B:
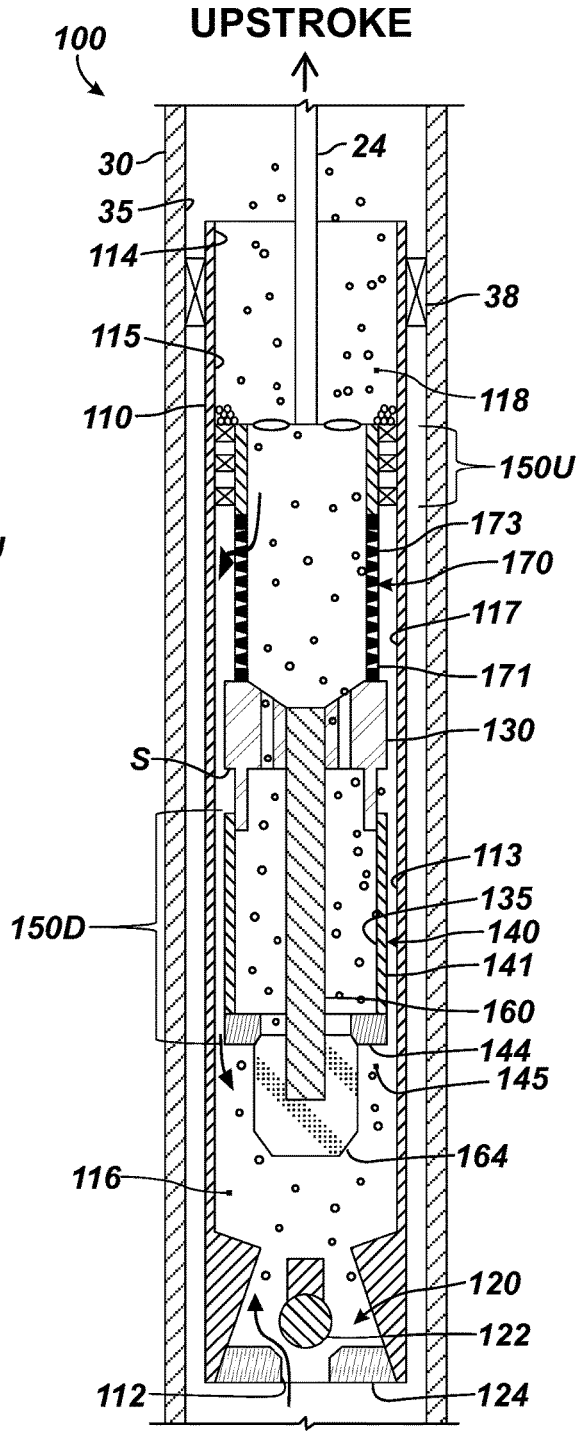
FIG. 2B illustrates the subsurface rod pump of FIG. 2A during an upstroke.

FIGS. 2A-2B illustrate a subsurface rod pump 100 according to the present disclosure for use in a sandy and gassy well. The pump 100 in FIGS. 2A-2B can be used with a reciprocating rod system, such as described previously with reference to FIGS. 1A-1B, to lift production fluids of the well to the surface. Advantageously, the pump 100 can produce sandy and gassy production fluid while preventing the sand from entering sealing areas on the pump 100 and while avoiding gas lock.

As shown, the pump 100 has a barrel 110 with a plunger 130 reciprocally disposed therein. The components of the pump 100 are schematically shown and are composed of suitable materials, housings, couplings, and the like as known in the art. The barrel 110 is disposed in a bore 35 of production tubing 30 with a pump seating nipple or other component 38 as conventionally done, and the plunger 130 is disposed for reciprocal movement in the barrel 110 with a reciprocating rod 24.

The barrel 110 defines an interior 115 in which the plunger 130 is disposed, and the plunger 130 defines an interior 135 as well. The barrel 110 has a standing valve 120 that restricts passage of fluid out of the barrel's inlet 112, but allows for passage of fluid into the inlet 112. In particular, the standing valve 120 permits fluid from the production tubing 30 to pass into the barrel's interior 115, but restricts fluid passage in the opposite direction. As shown, the standing valve 120 can be a one-way valve, such as a check valve have a ball 122 movable relative to a corresponding seat 124. Other types of one-way valves and check valves could be used, however.

For its part, the plunger 130 has a traveling valve 140 that restricts passage of fluid out of the plunger's interior 135, but allows for passage of fluid into the interior 135. In particular, the traveling valve 140 permits fluid from a variable volume chamber 116 between the valves 120 and 140 to enter the plunger's interior 135, but restricts fluid passage in the opposite direction. Reciprocation of the plunger 130 eventually allows for an upper volume 118 of fluid in the barrel 110 to be lifted out of the barrel's outlet 114 and to the surface in the tubing 30.

Preferably, the traveling valve 140 includes a sleeve 141 movable with a variable inlet 145, passage, gap, or the like relative to a distal bob 164 on the plunger 130. Unseated as shown in FIG. 2A, a seat 144 of the sleeve 141 opens the variable inlet 145 and allows fluid to enter the sleeve 141 and ultimately the interior 135 of the plunger 130. Seated as shown in FIG. 2B, however, the seat 144 of the sleeve 141 closes the variable inlet 145, preventing escape of the fluid from the interior 135 of the plunger 130.

An annulus 113 is formed between the plunger 130 and the barrel 110 and has uphole and downhole seals 150U and 150D. The uphole seal 150U can be a mechanical seal having pressure-balanced wiper seals or similar types of seals that are disposed about the outside of the plunger 130 and engage inside the barrel 110. During operation, the wiper seals of the uphole seal 150U keep produced particulate uphole of the pump 100 from entering the annulus 113 between the plunger 130 and barrel 110.

The downhole seal 150D can be any type of suitable seal. For example, the downhole seal 150D can be a mechanical seal that allows for fluid slippage for the purposes discussed herein. As alternatively shown in FIG. 2A, the downhole seal 150D can preferably be a fluid or hydrodynamic seal that uses the fluid trapped in the annulus 113 to hold pressure. The outside surface of the plunger 130 and/or the barrel 110 (especially along the extent where the fluid seal 150D is created) can be hardened with a coating or the like to increase resistance to wear.

Typically, the inside surface of the barrel 110 and the outside surface of the plunger 130 have a tight clearance to create the fluid seal 150D. The actual clearance can depend in part on the type of fluid to be encountered, such as heavy or light crude, expected particulate sizes, and other details of the pump 100. Preferably, the fluid seal 150D is a long hydrodynamic seal effective in extending the life of the pump 100.

Interposed between the seals 150U and 150D, the plunger has a filter 170. Fluid can pass through openings 171 in the filter 170 into the annulus 113 for pressure balance. A region 117 of the annulus 113 surrounding the filter 170 defines a pressure-balancing region that allows pressure to balance across the uphole seal 150U.

Although fluid can pass through, the filter 170 restricts passage of at least some of the particulates inside the plunger 130 from passing into the annulus 113. (It will be appreciated that the filter 170 may not restrict passage of all particulate therethrough. Yet, the filter 170 can be configured to restrict the passage of most particulate or at least larger particulate for a given implementation.) The filter 170 can be a wire-wrapped screen, a perforated tubular portion, a mesh screen, or any suitable type of barrier, medium, or the like for restricting passage of particulate matter, such as sand, in downhole production fluid.

Preferably, the filter 170 is a slotted, wire-wrapped screen having a circumferentially wound wire 173 forming a number of slots for the openings 171. The wrapped wire 173 can be profiled V-wire, which allows the slot's dimension to be precisely controlled. The narrower portion of the slotted openings 171 preferably face the interior 135 of the plunger 130 to help prevent particulate passing through the screen filter 170 from wedging between the wire 173 as fluid passes out to the annulus 113.

As can be seen, rather than screening the production fluid before it enters the barrel's interior 115 (although this could still be done), the pump 100 allows particulate to enter the barrel 110 so it can eventually be produced with the production fluid that has collected in the pump's upper volume 118. This means that produced particulate collects in the lifted column of fluid above the pump 100 so the pump 100 uses the seals 150U, 150D to prevent the produced particulate from entering sealing areas on the pump 100 during operation.

In operation, produced fluid from the formation enters the production tubing 30 downhole of the pump 100. As the reciprocating rod system reciprocates the rod 24 attached to the plunger 130, the produced fluid is lifted above the pump 100 and is eventually produced at the surface. During a downstroke by the rod 24 as shown in FIG. 2A, for example, the standing valve 120 closes. At the same time, the traveling valve 140 opens by the sleeve's seat 144 unseating from the bob 164 so fluid previously residing in the variable volume chamber 116 can pass through the open inlet 145 of the sleeve 141 and into the plunger's interior 135.

During the downstroke as shown in FIG. 2A, the seat 144 lifts off of the bob 164 due to fluid friction, pressure differential, and the like. The lifted seat 144 allows fluid and gas to pass through the inlet 145 and into the interior 135 of the plunger 130. This form of traveling valve can work better for the gassy fluid than a standard ball and seat because the friction between the sleeve 141 and the barrel 110 decreases the amount of pressure required to lift the seat 144 off the bob 164.

During the downstroke, the upper seal 150U maintains a barrier between the uphole and downhole portions of the pump 100 and keeps produced particulate above the pump 100 from entering the annulus 113 between the plunger 130 and barrel 110. Head pressure is present inside the barrel 110 above and below the plunger 130, inside the plunger 130, and in the pressure-balance region 117 outside the filter 170 below the uphole seal 150U. (As is known, head pressure refers to the pressure exerted by weight of the column of fluid above a given point.) Therefore, pressure is balanced across the wiper seals of the uphole seal 150U so that there is no slippage (i.e., fluid does not pass between the seal 150U and the surrounding surface of the barrel 110 engaged thereby). At the same time, pressure is also balanced across the fluid seal 150D in the annulus 113 so that there is no slippage there either.

During the upstroke by the rod 24 as shown in FIG. 2B, the traveling valve 140 closes by the seating of the seat 144 of the sleeve 141 with the bob 164. Movement of the closed traveling valve 140 upward creates reduced pressure within the pump's variable volume chamber 116. In turn, the standing valve 120 opens so production fluid and any particulate downhole of the pump 100 can be drawn into the variable volume chamber 116.

The space S shown in FIG. 2B between the sleeve 141 and portion of the plunger 130 will eventually be transferred to the bob/seat interface on the next downstroke. On the next downstroke then, the top portion of the plunger 130 would shift down, and the plunger sleeve 141 would move up, and the seat 144 would come off the bob 164 for the process to be repeated.

Looking at the upstroke in more detail, head pressure is present at the upper volume 118 inside the barrel 110 above the plunger 130 and in the pressure-balance region 117 outside the filter 170 below the wiper seals of the uphole seal 150U. As before, the wiper seals of the upper seal 150U are pressure-balanced so there is no slippage. In this way, the uphole seal 150U maintains the barrier between the uphole and downhole portions of the pump 100 and keeps produced sand above the pump 100 from entering the annulus 113 between the plunger 130 and barrel 110.

During the upstroke, fluid slippage can occur in the annulus 113 between the inside of the barrel 110 and the outside of the plunger 130, and fluid can pass from the interior 135 of the plunger 130 to the annulus 113 through the filter 170 to maintain the fluid seal 150D. As a result, a pressure differential occurs, reducing the pressure in the expanding volume chamber 116 to draw new production fluid and particulate into the barrel 110 past the standing valve 120.

As noted above, slippage fluid is filtered through the filter 170 on the upstroke. To do this, the filter 170 allows some of the lifted fluid in the plunger's interior 135 to pass through and enter the annulus 113 to maintain the fluid seal 150D. Yet, the filter 170 limits the size of particulate matter that can enter the hydrodynamic sealing annulus 113. In this way, larger particulates cannot enter the annulus 113 and abrade the surfaces, which would compromise the pumps operation. The annulus 113 is preferably sized larger than the particulate matter permitted to pass through the filter 170 so that the screened matter can pass through the hydrodynamic sealing annulus 113 without abrading the sealing surfaces forming the seal 150D. To achieve this, the average clearance of the annulus 113 is preferably equal to or greater than the width of the openings 171 (i.e., slots) in the filter 170 and any particulates that the filter 170 may pass.

For example, the filter 170 can be a screen having slots for the openings 171, and the slot size may be as small as 0.006-in. Thus, the difference between the barrel's ID and the plunger's OD is preferably greater than 0.012-in. This would produce an annulus 113 with an average clearance of about 0.006-in. around the inside of the barrel 110 and the outside of the plunger 130. Particulates larger than 0.006-in. that could cause damage if they were to pass in the annulus 113 are instead restricted by the filter 170. Meanwhile, fluid flow for pressure balancing and any smaller particulates (i.e., less than 0.006-in.) can still pass through the openings 171 in the filter 170 and into the annulus 113.

The upstroke and downstroke cycles of FIGS. 2A-2B are repeated, causing fluids to be lifted upward through the production tubing 30 and ultimately to the surface. Flow through the pump 100 continuously washes the interior surface of the filter 170, which can keep it from fouling. With this arrangement, sandy and gassy fluids produced from the formation will produce less wear on the sealing surfaces and will reduce gas locking. Being able to lift the sand with the gassy fluid means that any produced sand below the pump 100 will not foul a downhole screen or fill up the rathole.

As noted previously, the filter 170 installs at the pressure-balancing region 117 of the plunger 130. The pump 100 can be constructed with the filter 170 integrally formed as part of the plunger 130, or a separate screen assembly can be installed as an add-on. The filter 170 can be an insert assembly that couples upper and lower sections of the plunger 130 together, or the filter 170 can be a plug-type insert that screws onto the plunger 130.

Figure 3:
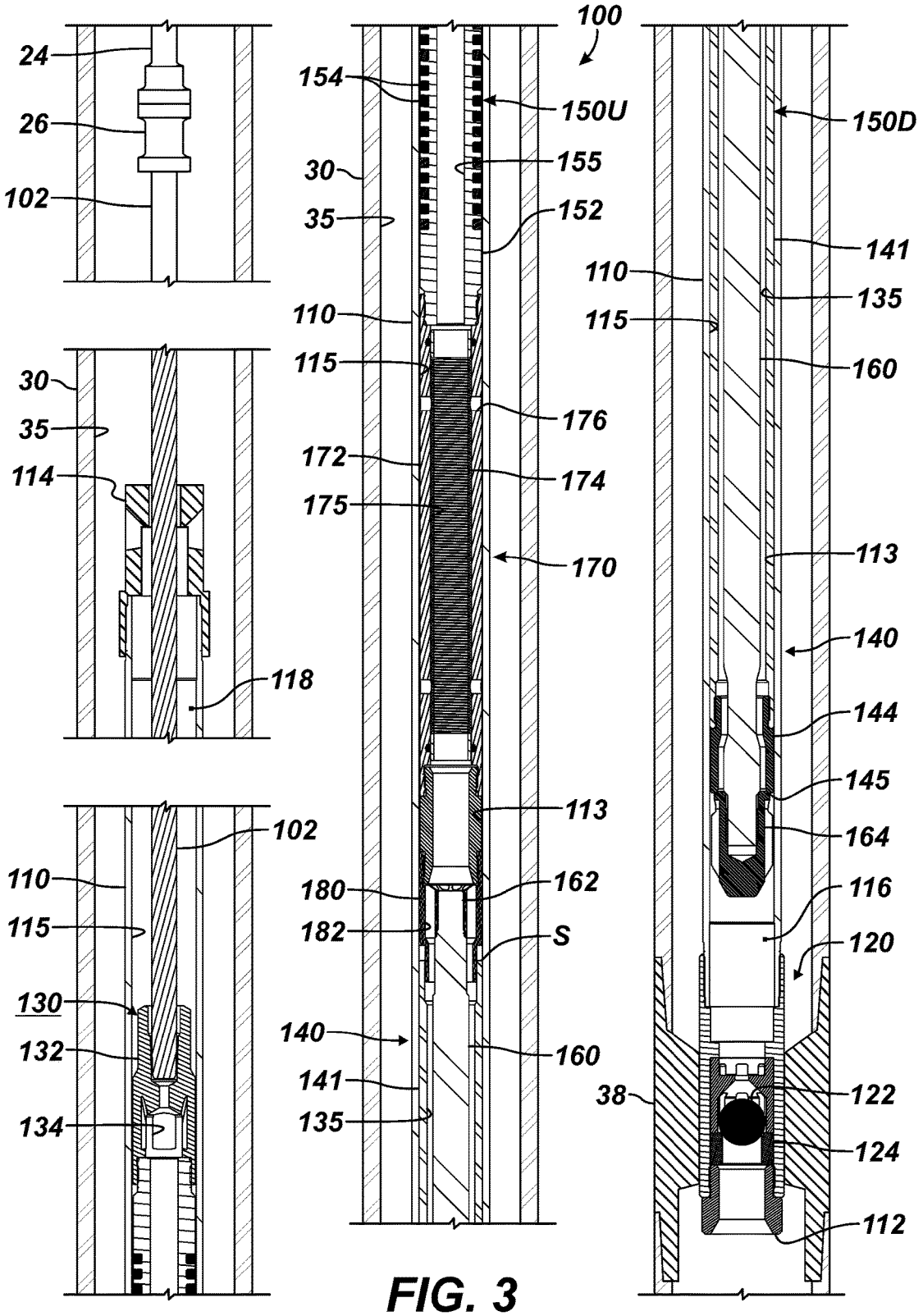
FIG. 3 illustrates another subsurface rod pump according to the present disclosure for use in a sandy and gassy well.
Figure 4:
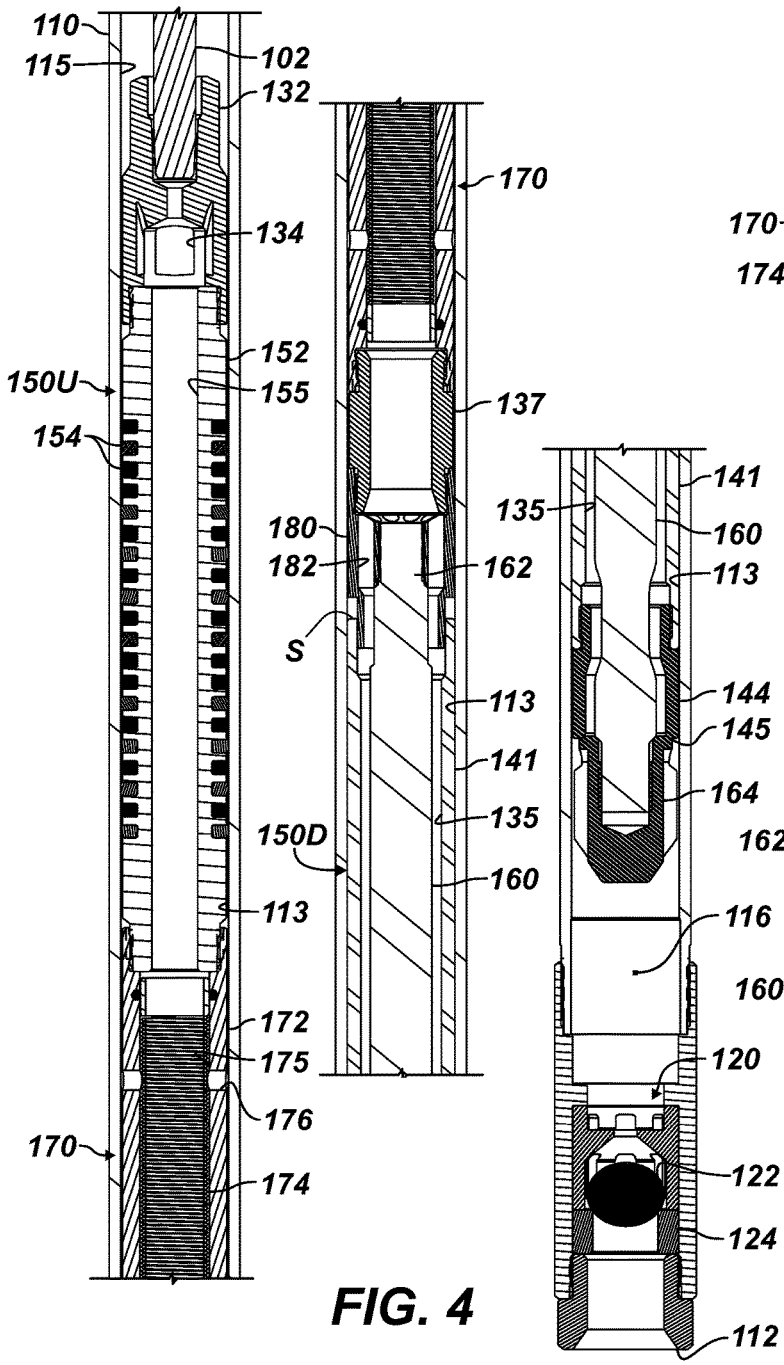
FIG. 4 illustrates a portion of the subsurface rod pump of FIG. 3 in isolated detail.
Figure 5:
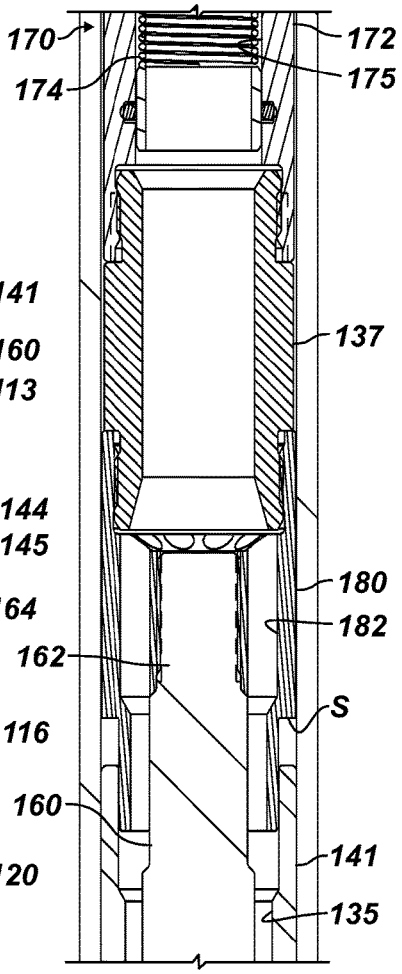
FIG. 5 illustrates another portion of the subsurface rod pump of FIG. 3 in isolated detail.

With an understanding of the disclosed pump 100, discussion now turns to FIG. 3, which illustrates another subsurface rod pump 100 according to the present disclosure for use in a sandy and gassy well. FIG. 4 illustrates a portion of this pump 100 of FIG. 3 in isolated detail, and FIG. 5 illustrates another portion of the pump 100 of FIG. 3 in isolated detail.

For assembly purposes, a number of subcomponents can be used for sections of the plunger 130 (i.e., an uphole seal component, a filter component, and a traveling valve component). These subcomponents can make the pump modular so that one or more sections can be added to an implementation to alter the function of the pump 100 as desired.

As shown in FIG. 3 and using the same reference numbers, the pump 100 installs downhole in production tubing 30 in a wellbore. Surrounding casing of the wellbore and other features are not shown in FIG. 3. A reciprocating rod string 24 connects by a coupling 26 to a pump rod 102, which runs through the pump's outlet 114 and into the pump's barrel 110. The pump rod 102 extends through the barrel 110 and connects to the plunger 130 at its proximal end 132.

As before, the barrel 110 has a standing valve 120, permitting fluid passage into the barrel's inlet 112 and restricting fluid passage out of the barrel's inlet 112. The barrel's downhole end at the pump's inlet 112 is fixed in the bore 35 of the tubing 30 is any number of available ways, such as with a seating nipple 38 or other component as conventionally done.

The plunger 130 is reciprocally disposed in the barrel 110 and has the uphole and downhole seals 150U, 150D with the barrel 110. A traveling valve 140 of the plunger 130 uses a sleeve 141 movably disposed on the plunger 130. An upper end of the sleeve 141 is movable on portion of the plunger 130 with a space S, while a seat 144 on the lower end of the sleeve 141 is movable with a variable gap or inlet 145 relative to a bob 164 at the distal end of the plunger 130. The movable sleeve 141 with its seat 144 forms the traveling valve with the bob 164, permitting fluid passage into the interior 135 and restricting fluid passage out of the interior 135 to the variable volume chamber 116 defined between the valves 120, 140.

As shown in FIG. 3, the proximal end 132 of the plunger 130 couples to the pump rod 102 and has fluid passages 134 for fluid in the plunger 130 to exit into the barrel 110 uphole of the uphole seal 150U. In turn, the outlet 114 of the barrel 110 has a central passage for the pump rod 102 and has fluid pathways for communicating fluid from the barrel 110 to the tubing 30.

On the present pump 100, the uphole seal 150U is a subcomponent coupled below the proximal end 132 and includes a mandrel 152 having an internal passage 155. A plurality of wiper seals 154 are disposed in circumferential grooves of the mandrel 152 to engage inside the barrel 110.

On the present pump 100, the filter 170 is also a subcomponent, which is coupled below the uphole seal 150U. The filter 170 includes a housing or mandrel 172 having an internal passage 175. A screen 174 is disposed in the passage 175 relative to leakage or equalization ports 176 communicating with the annulus 113. In this way, the filter 170 disposed on the plunger 130 between the seals 150U, 150D separates the interior 135 of the plunger 130 from the annulus 113 between the plunger 130 and the barrel 110. In other words, the filter 170 disposed on the plunger 130 between the seals 150U, 150D filters fluid in the interior 135 of the plunger 130 before it can pass to the annulus 113. As noted, the filter 170 permits fluid passage between the interior 135 and the annulus 113 and restricts particulate in the interior 135 from passing into the annulus 113.

On the present pump 100, the sleeve 141 extends below the filter 170 and is disposed about a stem 160 for supporting the bob 164. The stem 160 for supporting the bob 164 extends from a proximal end 162 connected to the plunger 130 inside the interior 135 to a distal end on which the bob 164 is installed.

As best shown in FIG. 4, the seat 144 can be a separate tubing component assembled on the end of the sleeve 141. The bob 164 may having flutes or centralizers so the extended stem 160 can be supported at its free distal end inside the barrel 110. Finally, the bob 164 and the seat 144 can have chamfered surfaces to facilitate engagement. The circumferential seating between the chamfered seat 144 and bob 164 may reduce the possibility of particulate from interfering with the opening/closing of the traveling valve during operation. (Notably, the space S for accommodating the sliding movement of the sleeve 141 is situated in the filtered area between the seals 150U, 150D and is less subject to having particulate interfere with the movement of the sleeve 141.)

As best shown in FIGS. 4-5, a bypass coupling 180 is used for connecting the stem's proximal end 162 to a portion of the plunger 130. (A tubing member 137 can be used to connect the bypass coupling 180 to the filter 170.) The bypass coupling 180 has bypass passages 182 formed thereabout for passage of fluid in the plunger's interior 135 past the connection of the stem 160 to the coupling 180.

Externally, the coupling 180 defines a ledge providing the space S relative to the sleeve 141 so the sleeve 141 can shift up/down as designed during pumping (to help break gas locking) and divert the production fluid through the filter 170 to allow it to filter the slippage fluid. This will maximize pump life and efficiency by minimizing wear of the plunger 130 and the barrel 110 due to solids, while effectively pumping gassy fluids.

Generally, the coupling 180 with its bypass passages 182 allows for fluid in the plunger's interior 135 to communicate past the connection of the stem 160 to the coupling 180. Because the fluid may contain particulates (e.g., sand) that is prevented from passing out of the filter 170, the coupling 180 interposed inside the plunger's interior 135 may tend to collect the particulate in the upper portion of the plunger's interior 135 so that it is less likely to collect in the sleeve 141 or even in the barrel 110 above the standing valve 120. Moreover, having the bypass passages 182 circumferentially arranged as shown, flow of fluid through the arranged passages 182 may further tend to clear the interior surface of the filter 170 and reduce accumulation and fouling.

To further handle gassy and sandy fluids, the pump apparatus of the present disclosure can further incorporate the teachings of co-pending U.S. application Ser. No. 15/299,978, filed 21 Oct. 2016 and entitled "Well Artificial Lift Operations with Sand and Gas Tolerant Pump," which is incorporated herein by reference. As shown in a configuration of FIG. 6A, the barrel 110 of the pump 100 includes a fluid chamber 119 formed therein, and the plunger 130 reciprocates in the barrel 110 with the filter 170 and other components moved relative to this fluid chamber 119.

The fluid chamber 119 is positioned longitudinally between two positions at which flow between the barrel 110 and the plunger 130 is restricted. For instance, a first longitudinal position is at a sliding interface between the barrel's upper interior portion 115*a* and the wiper seals 150U. A second longitudinal position is at a sliding interface between the plunger 130 and the barrel's lower interior portion 115*b*. As shown, the fluid chamber 119 can include an interior radially enlarged section of the barrel 110 positioned longitudinally between the interior portions 115*a-b*.

Figure 6A:
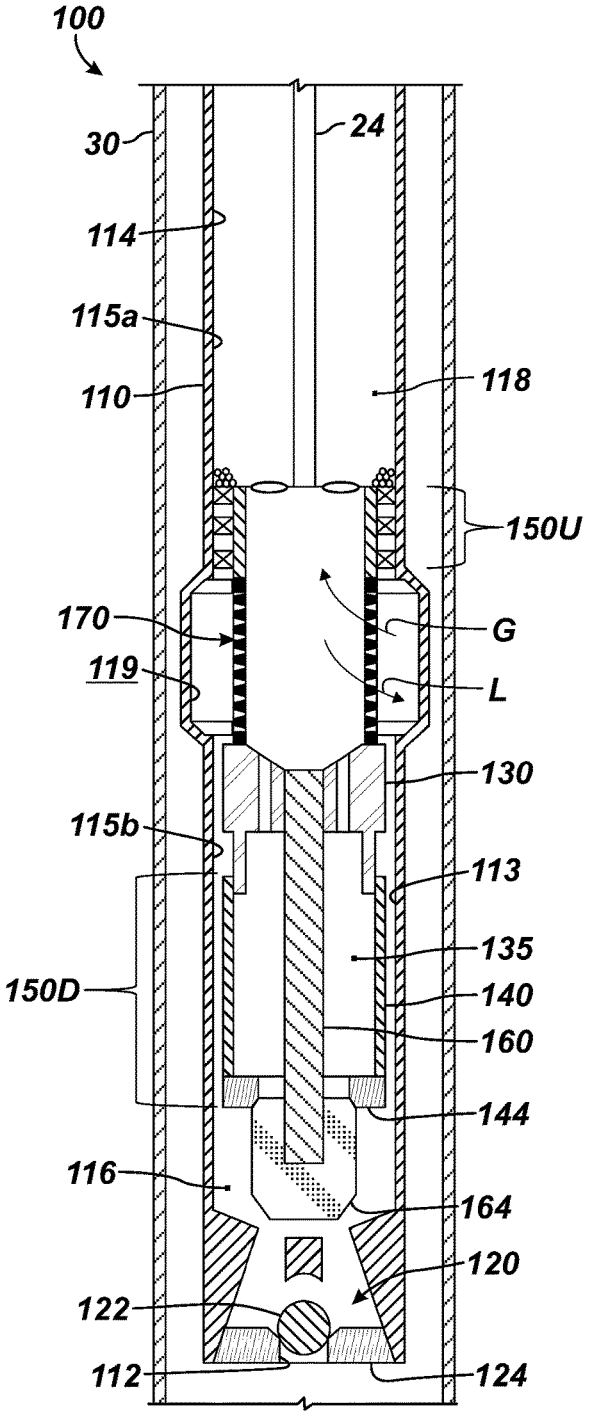
FIGS. 6A-6B illustrate yet another subsurface rod pump according to the present disclosure in two stages of operation.

As shown in FIG. 6A, the filter 170 filters fluid and can do so for fluid passing between the fluid chamber 119 and the plunger's interior 135. Fluid can pass through the filter 170 from the interior 135 to the fluid chamber 119. Fluid can also pass through the filter 170 in an opposite direction so that fluid can pass from the fluid chamber 119 into the interior 135 of the plunger 130 and can act to clean the filter 170 of any accumulated particulates. Ultimately, the filter 170 prevents particulate from passing into the fluid chamber 119 and the annular interface 113 between the barrel 110 and the plunger 130. Particulate excluded from the fluid passed by the filter 170 is instead lifted to the surface with the fluid via the tubing string 30.

At a lower extent of a downstroke as depicted in FIG. 6A, fluid is restricted between the plunger 130 and the barrel 110 at the first and second spaced apart positions longitudinally along the barrel 110, and the interior 135 of the plunger 130 is in communication via the filter 170 with the fluid chamber 119 disposed longitudinally between the first and second positions. Liquid L may pass from the plunger's interior 135 to the fluid chamber 119 via the filter 170. It may also be possible that any gas G in the fluid chamber 119 can also pass from the fluid chamber 119 to the plunger's interior 135 via the filter 170. In this manner, the gas G can be produced with the fluid 26 through the tubing string 30 to the surface.

Figure 6B:
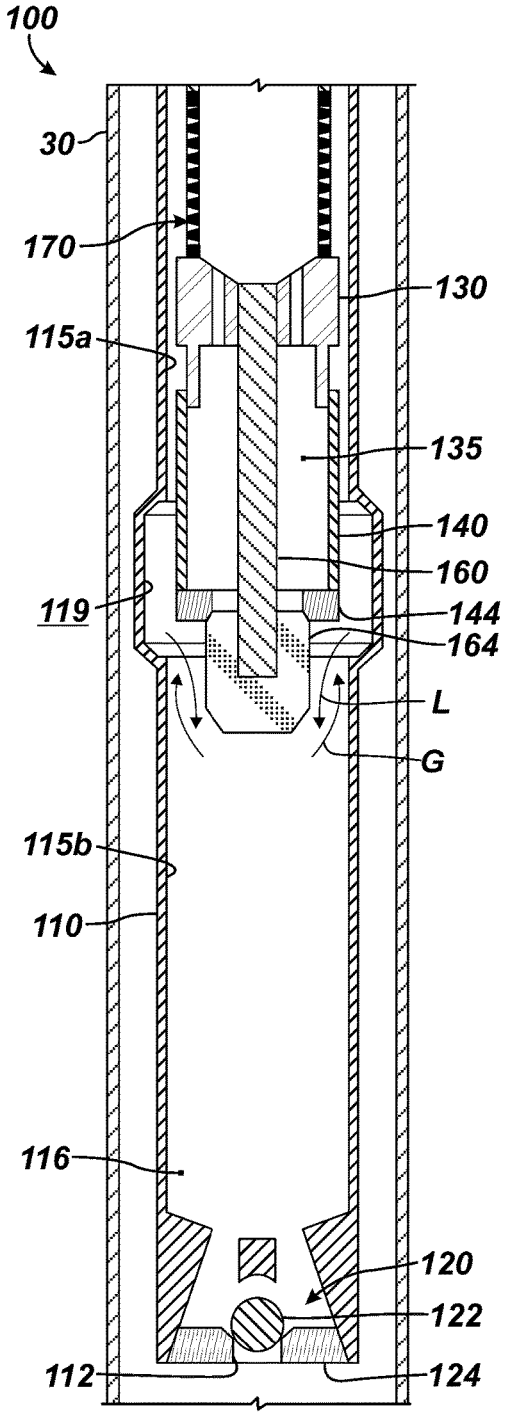

At an upper extent of the upstroke as depicted in FIG. 6B, the fluid chamber 119 is in communication with the variable volume chamber 116 and the standing valve 120, and the plunger 130 may extend only partially longitudinally across the fluid chamber 119. The liquid L may pass from the fluid chamber 119 to the variable chamber 116. Also, gas G in the variable chamber 116 can pass into the fluid chamber 119 (the gas G being less dense than the liquid L or any fluid also in the variable chamber 116).

Whether or not any of the fluid passes into the variable chamber 116 on the upward stroke of the plunger 130, a gas/liquid ratio in the chamber 116 can be reduced by the addition of the liquid L to the variable chamber 116, and by the passage of at least some of the gas G from the variable chamber 116 to the fluid chamber 119. Because the gas/liquid ratio in the variable chamber 116 is reduced, pressure in the variable chamber 116 will be increased upon a subsequent downward stroke of the plunger 130 to its lower stroke extent, as compared to the previous downward stroke of the plunger 130. Consequently, reciprocation of the plunger 130 between its upper and lower stroke extents can result in incremental decreases in the gas/liquid ratio in the variable chamber 116, producing corresponding incremental increases in the pressure in the variable chamber 116 when the plunger 130 is at its lower stroke extent. Eventually, pressure in the chamber 116 can increase sufficiently to cause the traveling valve 120 to open, and the fluids (e.g., gas G, liquid L, and other fluid) can pass from the variable chamber 116 to the plunger interior 135.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A subsurface reciprocating pump, comprising:

a barrel having a first valve permitting fluid passage into the barrel and restricting fluid passage out of the barrel;

a plunger reciprocally disposed in the barrel, the plunger having first and second seals in an annulus between the plunger and the barrel, the plunger defining an interior therein and having a bob extending at a distal end of the plunger;

a sleeve movably disposed on the plunger relative to the bob at the distal end of the plunger and forming a second valve therewith, the second valve permitting fluid passage from a variable volume in the barrel into the interior of the plunger and restricting fluid passage out of the interior; and a filter disposed on the plunger between the first and second seals and separating the interior of the plunger from the annulus between the plunger and the barrel, the filter permitting fluid passage between the interior and the annulus and restricting particulate in the interior from passing into the annulus.

2. The pump of claim 1, wherein the first seal comprises one or more wiper seals disposed outside the plunger and engaging inside the barrel.

3. The pump of claim 1, wherein the filter defines at least one opening with a dimension, and wherein the annulus defines an average clearance around an inside of the barrel and an outside of the plunger that is greater than or equal to the dimension of the at least one opening.

4. The pump of claim 1, wherein the filter prevents particulate greater than a dimension from passing therethrough, and wherein the annulus defines an average clearance around an inside of the barrel and an outside of the plunger that is greater than or equal to the dimension.

5. The pump of claim 1, wherein the filter comprises a wire-wrapped screen at least partially disposed about the plunger.

6. The pump of claim 1, wherein the first valve comprises a check valve having a ball movable relative to a seat.

7. The pump of claim 1, wherein the sleeve movable relative to the bob at the distal end of the plunger comprises a seat distanced by a variable gap from the bob and being engagable with the bob.

8. The pump of claim 1, wherein in a first stroke moving the barrel and the plunger relative to one another in a first direction, the variable volume decreases, the first valve closes, and the second valve opens.

9. The pump of claim 8, wherein in the first stroke, fluid entering the interior of the plunger from the variable volume through the second valve clears particulate adjacent a portion of the filter exposed to the interior of the plunger.

10. The pump of claim 1, wherein in a second stroke moving the barrel and the plunger relative to one another in a second direction, the variable volume increases, the first valve opens, and the second valve closes.

11. The pump of claim 10, wherein in the second stroke, the filter permits fluid passage from the interior of the plunger to the annulus and prevents at least some particulate in the interior of the plunger from passing out of the interior to the annulus.

12. The pump of claim 1, wherein the second seal comprises a fluid seal formed with fluid disposed in the annulus between the barrel and the plunger.

13. The pump of claim 1, wherein the plunger comprises:

a coupling disposed in the interior of the plunger; and a stem extending from the coupling to the bob, the sleeve movably disposed about the stem.

14. The pump of claim 13, wherein the coupling defines one or more fluid passageways communicating a lower portion of the interior with an upper portion of the interior past the coupling.

15. The pump of claim 14, wherein the one or more fluid passageways comprises a plurality of the fluid passageways circumferentially arranged about a center portion of the coupling connected to the stem, the circumferentially-arranged fluid passageways directing fluid from the lower portion toward an interior surface of the filter disposed inside the upper portion of the interior.

16. The pump of claim 1, wherein the barrel further comprises a chamber disposed in the barrel relative to a downstroke extent of the plunger in which liquid and gas are exchanged through the filter between the chamber of the barrel and the interior of the plunger.

17. The pump of claim 16, wherein the chamber is disposed in the barrel relative to an upstroke extent of the plunger in which liquid and gas are exchanged between the chamber of the barrel and the variable volume of the barrel between the first and second valves.

18. A reciprocating pump system for a well, the system comprising:

a surface unit reciprocating a rod in the well; and a subsurface pump disposed in a tubular in the well and actuated by the rod, the subsurface pump comprising— a barrel having a first valve permitting fluid passage into the barrel and restricting fluid passage out of the barrel;

a plunger reciprocally disposed in the barrel, the plunger having first and second seals in an annulus between the plunger and the barrel, the plunger defining an interior therein and having a bob extending at a distal end of the plunger;

a sleeve movably disposed on the plunger relative to the bob at the distal end of the plunger and forming a second valve therewith, the second valve permitting fluid passage from a variable volume of the barrel into the interior of the plunger and restricting fluid passage out of the interior; and a filter disposed on the plunger between the first and second seals and separating the interior of the plunger from the annulus between the plunger and the barrel, the filter permitting fluid passage between the interior and the annulus and restricting particulate in the interior from passing into the annulus.

19. The system of claim 18, wherein the barrel further comprises a chamber disposed in the barrel, the chamber relative to a downstroke extent of the plunger enabling liquid and gas to be exchanged through the filter between (i) the chamber of the barrel and (ii) the interior of the plunger, the chamber relative to an upstroke extent of the plunger enabling liquid and gas to be exchanged between (i) the chamber of the barrel and (ii) the variable volume of the barrel between the first and second valves.

20. A method of producing fluid in a sandy and gassy well, the method comprising:

sealing a plunger disposed in a barrel with first and second seals;

transferring a first volume of fluid trapped in a first interior of the barrel into a second interior of the plunger by reciprocating the plunger and the barrel relative to one another in a first direction and unseating a movable sleeve on the plunger from a distal bob;

lifting uphole a second volume of fluid trapped in the second interior of the plunger by reciprocating the plunger and the barrel relative to one another in a second direction and seating the movable sleeve on the plunger against the distal bob;

preventing particulate uphole of the plunger from passing in an annulus between the plunger and the barrel using the first seal;

permitting fluid communication between the second interior of the plunger and the annulus between the first and second seals; and preventing at least some particulate in the second interior of the plunger from passing out of the plunger to the annulus.

* * * * *